US007387398B2

(12) United States Patent
Yokota

(10) Patent No.: US 7,387,398 B2
(45) Date of Patent: Jun. 17, 2008

(54) CHAMBER LIGHT SOCKET AND REFRIGERATOR

(75) Inventor: Toshiharu Yokota, Saitama (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 10/562,003

(22) PCT Filed: Jun. 25, 2004

(86) PCT No.: PCT/JP2004/008996

§ 371 (c)(1),
(2), (4) Date: Dec. 23, 2005

(87) PCT Pub. No.: WO2005/001354

PCT Pub. Date: Jan. 6, 2005

(65) Prior Publication Data

US 2006/0152914 A1 Jul. 13, 2006

(30) Foreign Application Priority Data

Jun. 30, 2003 (JP) ..... 2003-187075

(51) Int. Cl.
*F21V 29/00* (2006.01)

(52) U.S. Cl. ..... 362/92; 362/378; 62/264; 439/280; 439/340; 439/382

(58) Field of Classification Search ..... 362/92, 362/95, 378, 443, 651, 353; 439/382–385, 439/280, 340, 109, 666, 667, 918; 62/264
See application file for complete search history.

(56) References Cited

U.S. PATENT DOCUMENTS

| | | | | |
|---|---|---|---|---|
| 819,702 | A * | 5/1906 | Murphy | 439/309 |
| 3,915,328 | A * | 10/1975 | Hawes et al. | 220/592.06 |
| 2003/0034322 | A1 * | 2/2003 | Doherty et al. | 215/228 |

FOREIGN PATENT DOCUMENTS

| | | | |
|---|---|---|---|
| DE | 3217254 | A * | 12/1982 |
| EP | 0892230 | A1 * | 1/1999 |
| JP | 2000-240934 | | 9/2000 |
| JP | 2002-164138 | | 6/2002 |
| JP | 2002164138 | A * | 6/2002 |

* cited by examiner

*Primary Examiner*—Sharon Payne
*Assistant Examiner*—Mary Zettl
(74) *Attorney, Agent, or Firm*—Kratz, Quintos & Hanson, LLP

(57) ABSTRACT

An object is to provide a chamber lamp socket in which a chamber lamp can be prevented from being loosened even if there is strong impact or vibration and from which the chamber lamp can be easily detached, and a combustible refrigerant applied refrigerator in which the chamber lamp socket is adopted. In the refrigerator provided with the chamber lamp socket attached to the inside of a chamber and the chamber lamp attached to and supported by this chamber lamp socket, the chamber lamp socket includes a socket main body provided with a lamp holder to be engaged with a mouthpiece of the chamber lamp, and a support member whose tip portion is brought into contact with an outer periphery of a light emitting portion glass tube of the chamber lamp to hold the lamp and which is formed of a flexible material, and the tip portion of the support member has a sawtoothed shape constituted by alternately forming gentle slopes and steep slopes in such a manner that a resistance in detaching the chamber lamp is larger than that in attaching the chamber lamp.

15 Claims, 3 Drawing Sheets

CHAMBER LIGHT SOCKET AND REFRIGERATOR

BACKGROUND OF THE INVENTION

The present invention relates to a chamber lamp socket attached to the inside of a chamber of a refrigerator, and a refrigerator provided with this chamber lamp socket.

In a thermostatic chamber or a household refrigerator, a chamber lamp socket is disposed in an appropriate position in a chamber. Moreover, a mouthpiece of the chamber lamp which lights at a time when an insulating door opens is engaged with a lamp holder of the chamber lamp socket to constitute a chamber lamp device (see U.S. Pat. No. 5,408,392).

Additionally, in the above-described chamber lamp device, the engagement of the mouthpiece with the lamp holder loosens owing to vibrations at the time when the refrigerator door opens or closes, vibrations due to an operation of a compressor constituting a refrigeration cycle, or the like, and the chamber lamp does not light at the time when the door opens in some case.

Moreover, refrigerators increase in which combustible hydrocarbon-based refrigerant (butane, isobutene, propane or the like) is used in a refrigeration cycle constituted by connecting a compressor, a condenser, and an evaporator via pipes to form a refrigerant circulating path. Furthermore, in a case where the refrigerant leaks from the refrigeration cycle in the refrigerator in which the combustible refrigerant is used, when the chamber lamp loosens and sparks are generated between the mouthpiece and the lamp holder, there is a fear that the sparks cause ignition on the leaked refrigerant.

To solve the problem, a refrigerator is known in which an insulating portion of a socket main body is provided with a collar portion to be closely attached to a glass tube of the chamber lamp to reduce the looseness of the chamber lamp, and the mouthpiece is physically separated from a contact portion of the lamp holder to prevent invasion of the combustible refrigerant (see Japanese Patent Application Laid-Open No. 2002-164138).

However, even in this type of refrigerator, the chamber lamp loosens in rare cases. To solve the problem, it is proposed that the collar portion be formed to be large, and a closely attached area with respect to the glass tube be enlarged. However, in this case, a large force is required for the engagement of the chamber lamp, and operations to attach and detach the chamber lamp become laborious.

Furthermore, in this type of refrigerator, when the collar portion is closely attached to the glass tube of the chamber lamp for many years, both of the collar portion and the glass tube stick to each other. When they are removed from each other once, this state returns to an original state.

The chamber lamp is usually positioned in an inner portion of the chamber of the refrigerator. Therefore, in the refrigerator at a time when several years have passed after the refrigerant was purchased, the chamber lamp expires. To change the lamp, a user stretches out his arm into the chamber to manually hold, turn, and detach the chamber lamp. In this case, the collar portion sticks to the glass tube of the chamber lamp. Therefore, the user has to stretch out his arm, manually hold the glass chamber lamp, and apply such a sufficient force as to prevent this glass chamber lamp from being broken in detaching the chamber lamp. This is very difficult.

SUMMARY OF THE INVENTION

The present invention has been developed in view of the above-described respect, and an object thereof is to provide a chamber lamp socket and a refrigerator with respect to which a chamber lamp can be securely attached and detached.

Another object of the present invention is to provide a chamber lamp socket and a refrigerator in which a glass tube can be easily removed from a collar portion by manually turning a chamber lamp even in a case where the collar portion brought into contact with an outer periphery of the glass tube of the chamber lamp to hold the glass tube is closely attached to the glass tube of the chamber lamp for many years, and the collar portion sticks to the glass tube.

A first aspect of the present invention is directed to a refrigerator provided with a chamber lamp socket attached to the inside of a chamber, and a chamber lamp attached to and supported by the chamber lamp socket, the refrigerator having a collar portion which is provided with unevenness on an inner surface of a tip portion thereof, brought into contact with an outer periphery of a glass tube of the chamber lamp to hold the lamp, and formed of a flexible material.

A second aspect of the present invention is directed to the refrigerator of the first aspect, wherein the unevenness has a sawtoothed shape constituted by alternately forming gentle slopes and steep slopes to set a resistance in detaching the chamber lamp to be larger than that in attaching the chamber lamp.

A third aspect of the present invention is directed to the refrigerator of the first or second aspect, wherein an intermediate portion of the collar portion is provided with an annular protruding portion which is closely attached to the outer periphery of the glass tube of the chamber lamp.

A fourth aspect of the present invention is directed to the refrigerator of any one of the first to third aspects, wherein a combustible refrigerant is used as a refrigerant.

A fifth aspect of the present invention is directed to the refrigerator of any one of the first to fourth aspects, wherein the chamber lamp is driven by a commercial power supply voltage.

A sixth aspect of the present invention is directed to the refrigerator of any one of the first to fifth aspects, wherein the collar portion is formed of a polyvinyl chloride resin material.

A seventh aspect of the present invention is directed to a chamber lamp socket provided with a collar portion which is brought into contact with an outer periphery of a glass tube of a chamber lamp to hold the lamp and which is formed of a flexible material, wherein unevenness is formed on an inner surface of the collar portion.

An eighth aspect of the present invention is directed to the refrigerator of the seventh aspect, wherein the unevenness has a sawtoothed shape constituted by alternately forming gentle slopes and steep slopes to set a resistance in detaching the chamber lamp to be larger than that in attaching the chamber lamp.

A ninth aspect of the present invention is directed to the refrigerator of the seventh or eighth aspect, wherein an intermediate portion of the collar portion is provided with an annular protruding portion to be closely attached to the outer periphery of the glass tube of the chamber lamp.

A tenth aspect of the present invention is directed to the refrigerator of any one of the seventh to ninth aspects, wherein the collar portion is formed of a polyvinyl chloride resin material.

According to the present invention, even in a case where the collar portion brought into contact with the outer periphery of the glass tube of the chamber lamp to hold the glass tube is closely attached to the glass tube of the chamber lamp for many years, and the collar portion sticks to the glass tube, the glass tube can be easily removed from the collar portion by manually turning the chamber lamp.

Moreover, even when a degree of close contact between the collar portion and the glass tube is raised to prevent the chamber lamp from being loosened, a large force is not required for attaching the chamber lamp, and the chamber lamp can be easily attached.

Furthermore, even when the combustible refrigerant is used, generation of sparks can be avoided. Furthermore, the combustible refrigerant can be prevented from being introduced into a spark generating portion, and it is possible to provide the refrigerator in which safety is enhanced.

DETAILED DESCRIPTION OF THE PREFERRED EMBODIMENT

Figure 1:
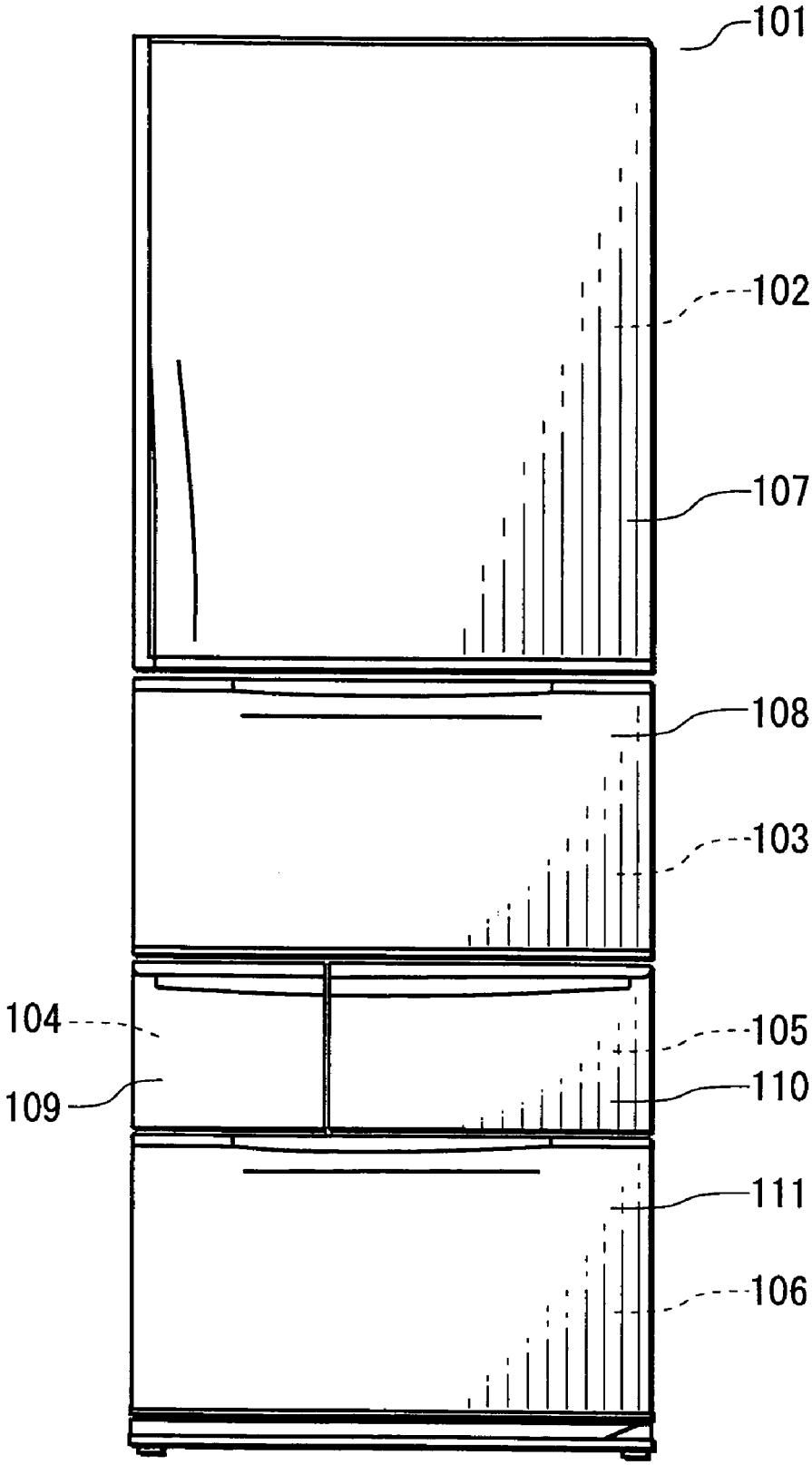
FIG. 1 is a front view of a refrigerator to which the present invention is applied.

An embodiment of the present invention will be described hereinafter with reference to the drawings.

First, reference numeral 101 denotes a refrigerator main body constituted of a plurality of food preserving chambers each provided with a front door. This refrigerator main body 101 is constituted of an insulating material such as urethane foam charged in an outer box and an inner box and between both of the boxes. The inside of this refrigerator main body 101 is partitioned by partition walls having an insulating function. From an upper part of the main body, there are arranged a refrigerating chamber 102, a vegetable chamber 103, an ice compartment 104, a temperature switching chamber 105 which can be set to an environment at a temperature of −18° C. to 6° C. by user's selection, and a freezing chamber 106.

Moreover, a front-surface opening of the refrigerating chamber 102 can be closed by an openably closing rotary refrigerating chamber door 107. The vegetable chamber 103, ice compartment 104, temperature switching chamber 105, and freezing chamber 106 arranged under the refrigerating chamber 102 are closed by a drawer type of vegetable chamber door 108, ice compartment door 109, temperature switching chamber door 110, and freezing chamber door 111, respectively. Each of the doors are constituted by charging an insulating material such as urethane foam between each door outer box constituted of a steel plate and a door inner box constituted of a hard resin material.

Figure 4:
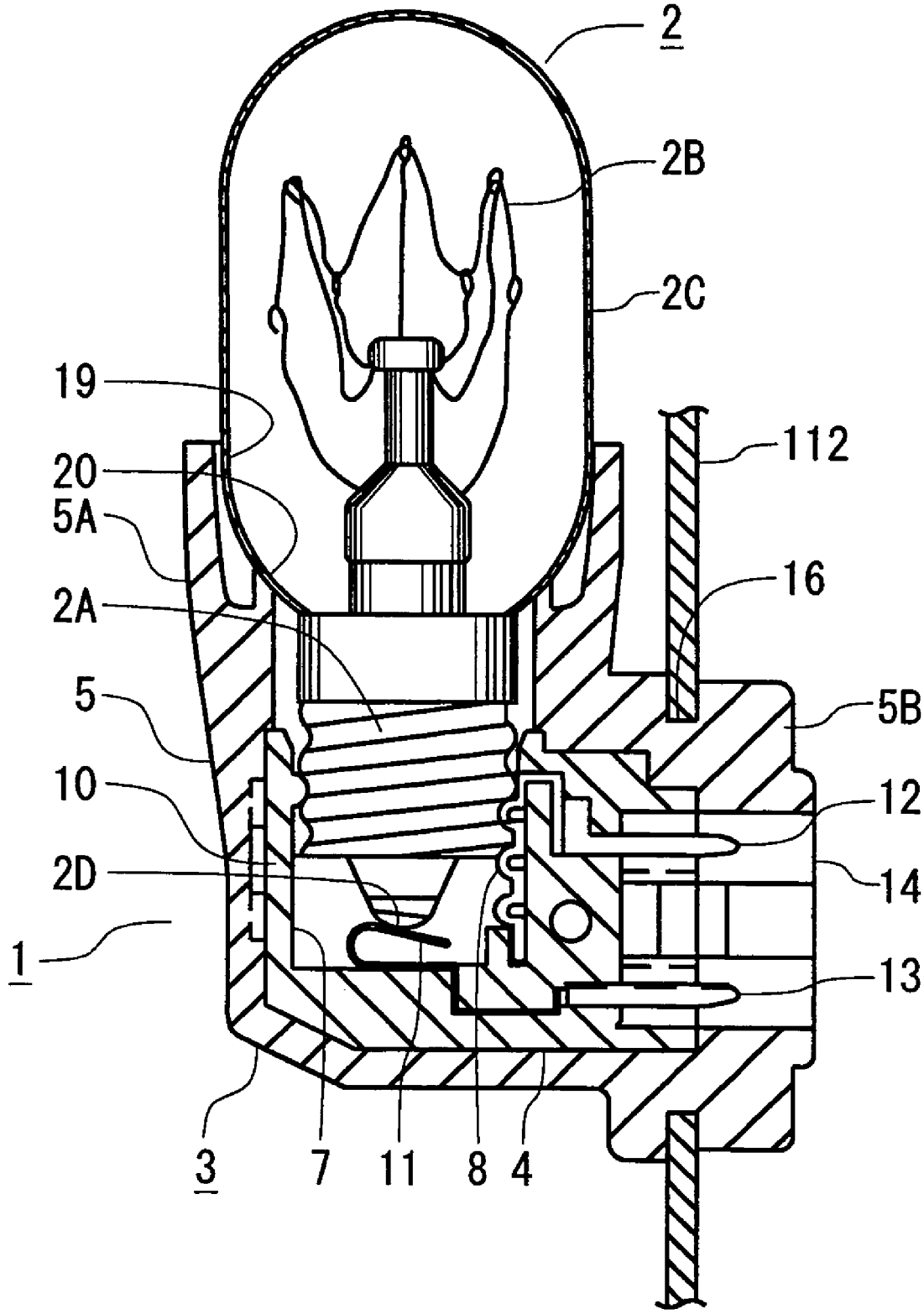
FIG. 4 is a vertical side view of the chamber lamp device to which the chamber lamp is attached.

Furthermore, in FIG. 4, reference numeral 1 denotes a chamber lamp device disposed in the refrigerator, that is, the freezing chamber 106, the refrigerating chamber 102, and the like. This chamber lamp device 1 is constituted of a chamber lamp 2 and a chamber lamp socket 3. Moreover, the chamber lamp 2 is driven by a commercial power voltage to light by means of a control unit (not shown), only when each door 107 or 111 of the refrigerator opens.

Figure 2:
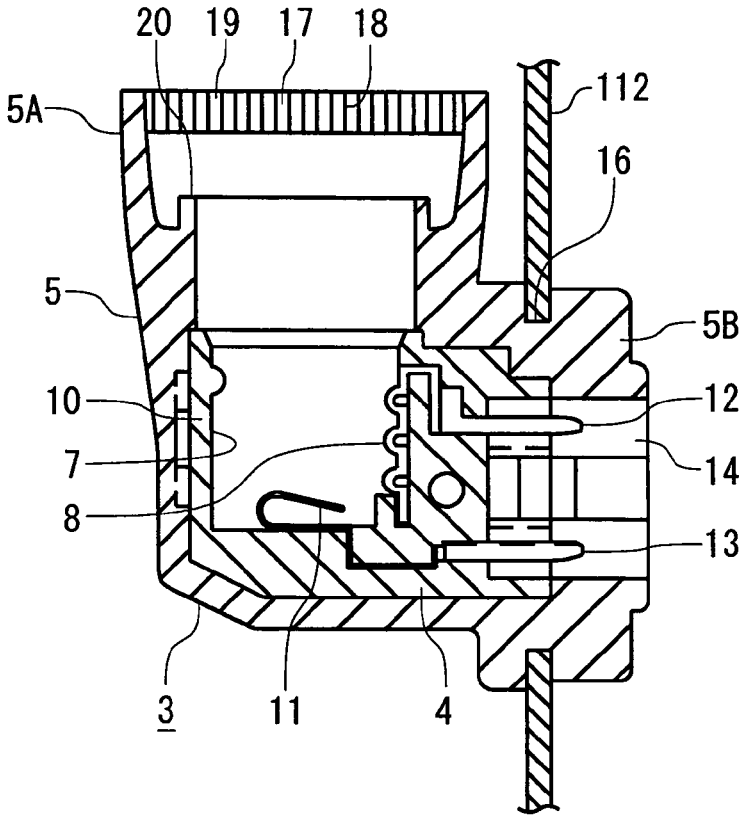
FIG. 2 is a vertical side view of a chamber lamp device to which any chamber lamp is not attached.

The chamber lamp socket 3 is constituted of a socket main body 4, and a support member 5 attached to an inner box back wall 112 of the main body 101 to cover the whole socket main body 4. Moreover, the socket main body 4 is formed of an insulating member such as a synthetic resin material, and a lamp holder 8 to be engaged with a mouthpiece 2A of the chamber lamp 2 is disposed on an inner peripheral wall 7 of a chamber lamp attaching portion 10 having a bottomed cylindrical shape. A center contact piece 11 is attached to a lower part (bottom part in FIG. 2) of this lamp holder 8. Furthermore, the lamp holder 8 and the center contact piece 11 are connected to male terminals 12 and 13 to be connected to female connectors.

The support member 5 is formed of a flexible synthetic resin material such as a deformable flexible polyvinyl chloride resin, and has such a bottomed cylindrical shape as to cover an outer periphery of the socket main body 4. A tip cylindrical portion 5A of the member extends upwards from the socket main body 4, and spreads slightly outwardly. A cylindrical attaching base 5B having a connector insertion port 14 is disposed in a side part of the main body, and a groove 16 into which the inner box back wall 112 is fitted is formed in the attaching base.

Moreover, an inner surface of the tip cylindrical portion 5A of the support member 5 is formed to be uneven in such a manner as to repeat recessed portions and protruding portions so that a glass tube 2C of the chamber lamp 2 is easily removed from the support member by manually turning the chamber lamp 2, even in a case where the support member is closely attached to the glass tube for many years, and they stick to each other.

Figure 3:
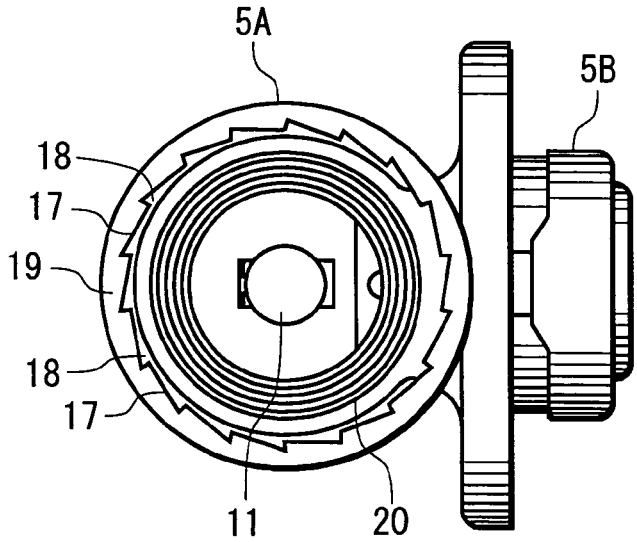
FIG. 3 is a plan view of the chamber lamp device to which any chamber lamp is not attached.

Specifically, as shown in FIG. 3, the inner surface of the tip cylindrical portion 5A of the support member 5 has a sawtoothed shape in which gentle slopes 17 and steep slopes 18 both having flat-surface shapes are alternately formed. This gentle slope 17 is formed in such a manner that the slope comes close to the center of the tip cylindrical portion 5A toward a direction in which the chamber lamp 2 is attached, that is, a direction of movement in rotating the chamber lamp 2 clockwise. Conversely, the slope is formed to be far from the center of the tip cylindrical portion 5A toward a direction in which the chamber lamp 2 is removed, that is, a direction of movement in rotating the chamber lamp 2 counterclockwise. An annular protruding portion 20 positioned inside a sawtoothed portion 19 and protruded upwards is disposed in an intermediate portion of the support member 5 under the sawtoothed portion 19. It is to be noted that the tip cylindrical portion 5A and the annular protruding portion 20 constitute a collar portion.

As shown in FIG. 4, in a case where the mouthpiece 2A of the chamber lamp 2 is attached to the chamber lamp socket 3, the sawtoothed portion 19 comes in contact with an intermediate portion of the transparent glass tube 2C of a light emitting portion 2B of the chamber lamp 2, and the protruding portion 20 is closely attached to a lower part of the glass tube 2C. The gentle slopes 17 and the steep slopes 18 are arranged in such a manner that an outer peripheral surface of the glass tube 2C contacts the gentle slopes 17 of the sawtoothed portion 19, thereby reducing a sliding resistance, when the chamber lamp 2 is attached. The outer peripheral surface of the glass tube 2C contacts the steep slopes 18 of the sawtoothed portion 19, thereby increasing the sliding resistance, when the chamber lamp is detached.

When the chamber lamp 2 is attached to the chamber lamp socket 3 constituted as described above, the mouthpiece 2A is fitted into the lamp holder 8 to thereby bring a tip terminal 2D of the mouthpiece 2A into contact with the center contact piece 11, and substantially ⅓ of the transparent glass tube 2C covering the light emitting portion 2B of the chamber lamp 2 is covered with the tip cylindrical portion 5A of the support member 5. In this case, a part (part close to the center of the gentle slope 17) of the gentle slope 17 of the sawtoothed portion 19 on the inner surface of the tip cylindrical portion 5A is brought into contact with the intermediate portion of the glass tube 2C (in this case, the part is not brought into contact with the steep slope 18). Moreover, the protruding portion 20 is pressed onto the lower art of the glass tube 2C, and brought into surface contact with the glass tube 2C in a closely attached state.

Therefore, a holding force of the chamber lamp 2 by the chamber lamp socket 3 increases, the holding of the chamber lamp 2 by the chamber lamp socket 3 is assured, and a torque required for loosening the chamber lamp 2 or attaching and tightening the lamp increases. Vibrations due to opening and closing of the refrigerating chamber door 107 or the like or due to operation of a refrigeration cycle are transferred to vibrate the chamber lamp socket 3 or the chamber lamp 2. Even in this case, the chamber lamp 2 can be prevented from being rotated by the vibrations.

Moreover, even when the support member 5 is closely attached to the glass tube 2C of the chamber lamp 2 for many years, and they stick to each other, an only part of the gentle slope 17 sticks that is the protruding portion of the sawtoothed portion 19. Therefore, when the chamber lamp 2 is manually turned, the chamber lamp can be easily detached.

Furthermore, when the chamber lamp 2 rotates in a tightening direction, that is, attaching direction, the glass tube 2C of the chamber lamp 2 abuts on the gentle slope 17 of the sawtoothed portion 19. Since a sliding resistance is small, the rotation of the lamp is permitted. However, when the chamber lamp 2 rotates in a loosening direction, that is, detaching direction, the glass tube 2C of the chamber lamp 2 abuts on the steep slope 18 of the sawtoothed portion 19, and the sliding resistance increases. Therefore, this rotation can be securely inhibited. Even if there is strong impact or vibration, the chamber lamp 2 can be prevented from being wobbled.

As a result, the chamber lamp 2 can be securely prevented from being loosened with respect to the chamber lamp socket 3, and it is possible to securely retain contact between the mouthpiece 2A and the center contact piece 11, that is, contact between the terminal 2D of the tip of the mouthpiece 2A and the center contact piece. Therefore, it is possible to securely avoid generation of sparks that might be generated when the contact between the mouthpiece 2A and the center contact piece 11 becomes uncertain in the refrigerator in which the combustible refrigerant is used.

Furthermore, it is possible to satisfy requirements "when the mouthpiece is inserted into the lamp socket with a torque of 1.0±0.1 Nm, a torque required for turning the mouthpiece by 150 to partially return the mouthpiece, and thereafter removing this mouthpiece is set to 0.3±0.1 Nm or more" defined in, for example, "the Japan Electrical Manufacturer's Association (JEMA), Voluntary Standards, Safety and General Requirements of Hydrocarbon-based Refrigerant Applied Refrigerator".

Additionally, since the glass tube 2C of the chamber lamp 2 is closely attached to the annular protruding portion 20 on the inner surface of the tip cylindrical portion 5A of the support member 5, a gas around the chamber lamp can be securely prevented from flowing on the side of the mouthpiece 2A. It is possible to more securely avoid the generation of the sparks even in a case where a combustible hydrocarbon-based refrigerant is used in the refrigerator.

It is to be noted that the tip cylindrical portion 5A of the support member 5 is brought into contact with the outer peripheral surface of the glass tube 2C close to the light emitting portion 2B with a small area via a part (part close to the center of the tip cylindrical portion 5A of the gentle slope 17) of the chamber lamp device of the sawtoothed portion 19. Therefore, little heat is conducted from the glass tube 2C. Even when a flexible resin material is used, the support member is prevented from being thermally deformed, and it is possible to inhibit proceeding of deterioration due to heat with an elapse of years.

The embodiment of the present invention has been described above, various alternatives, modifications, or variations are possible for any person skilled in the art based on the above description, and the present invention include various alternatives, modifications, or variations described above without departing from the scope of the present invention.

What is claimed is:

1. A refrigerator provided with a chamber lamp socket attached to the inside of a chamber, and a chamber lamp attached to and supported by the chamber lamp socket, comprising:

a collar portion of said chamber lamp socket which is provided with unevenness on an inner surface thereof, brought into contact with an outer periphery of a glass tube of the chamber lamp to hold the lamp, and formed of a flexible material wherein the unevenness of the inner surface of said lamp chamber socket has a sawtoothed shape constituted by alternately forming gentle slopes and steep slopes to set a resistance in detaching the chamber lamp to be larger than a resistance in attaching the chamber lamp, said sawtooth shape comes into direct contact with said glass tube of said chamber lamp and said gentle and steep slopes of said sawtoothed shape are horizontal to a vertical axis of said chamber lamp.

2. The refrigerator according to claim 1, wherein an intermediate portion of the collar portion is provided with an annular protruding portion which is closely attached to the outer periphery of the glass tube of the chamber lamp.

3. The refrigerator according to claim 2, wherein a combustible refrigerant is used as a refrigerant.

4. The refrigerator according to claim 3, wherein the chamber lamp is driven by a commercial power supply voltage.

5. The refrigerator according to claim 2, wherein the collar portion is formed of a polyvinyl chloride resin material.

6. The refrigerator according to claim 2, wherein the chamber lamp is driven by a commercial power supply voltage.

7. The chamber lamp socket according to claim 1, wherein the collar portion is formed of a polyvinyl chloride resin material.

8. The refrigerator according to claim 1, wherein a combustible refrigerant is used as a refrigerant.

9. The refrigerator according to claim 8, wherein the chamber lamp is driven by a commercial power supply voltage.

10. The refrigerator according to claim 9, wherein the chamber lamp is driven by a commercial power supply voltage.

11. The refrigerator according to claim 1, wherein the chamber lamp is driven by a commercial power supply voltage.

12. A chamber lamp socket comprising:

a collar portion at one end of the chamber lamp socket which is brought into contact with an outer periphery of a glass tube of a chamber lamp to hold the lamp and which is formed of a flexible material, wherein a sawtoothed shape which comes in direct contact with said glass tube of said chamber lamp is formed on an inner surface of the collar portion, said sawtoothed shape constituted by alternately forming gentle slopes and steep slopes to set a resistance in detaching the chamber lamp to be larger than a resistance in attaching the chamber lamp and said gentle and steep slopes of said sawtoothed shape are horizontal to a vertical axis of said chamber lamp.

13. The chamber lamp socket according to claim 12, wherein an intermediate portion of the collar portion is provided with an annular protruding portion to be closely attached to the outer periphery of the glass tube of the chamber lamp.

14. The chamber lamp socket according to claim 13, wherein the collar portion is formed of a polyvinyl chloride resin material.

15. The chamber lamp socket according to claim 12, wherein the collar portion is formed of a polyvinyl chloride resin material.

* * * * *